US010947465B2

(12) United States Patent
Lawson et al.

(10) Patent No.: US 10,947,465 B2
(45) Date of Patent: Mar. 16, 2021

(54) PROCESS AND SYSTEM FOR CRACKING A HYDROCARBON FEED

(71) Applicant: SABIC Global Technologies, B.V., Bergen op Zoom (NL)

(72) Inventors: Kenneth Francis Lawson, Peterlee (GB); Andrea del Pilar Niño-Garcia, Maastricht (NL)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 16/633,827

(22) PCT Filed: Aug. 10, 2018

(86) PCT No.: PCT/IB2018/056039

§ 371 (c)(1),
(2) Date: Jan. 24, 2020

(87) PCT Pub. No.: WO2019/034977

PCT Pub. Date: Feb. 21, 2019

(65) Prior Publication Data

US 2020/0255752 A1 Aug. 13, 2020

Related U.S. Application Data

(60) Provisional application No. 62/545,524, filed on Aug. 15, 2017.

(51) Int. Cl.
*C10G 67/04* (2006.01)
*C10G 65/10* (2006.01)
(Continued)

(52) U.S. Cl.
CPC ..... *C10G 67/14* (2013.01); *C10G 5/04* (2013.01); *C10G 65/10* (2013.01); *C10G 67/04* (2013.01);
(Continued)

(58) Field of Classification Search
CPC .. C10G 47/00–35; C10G 65/10; C10G 67/04; C10G 67/14
See application file for complete search history.

(56) References Cited

U.S. PATENT DOCUMENTS 4,272,270 A * 6/1981 Higgins ..... C01B 3/506 62/623
4,283,271 A 8/1981 Garwood et al.
(Continued)

FOREIGN PATENT DOCUMENTS

WO 2013182534 A1 12/2013
WO 2015000841 A1 1/2015
(Continued)

OTHER PUBLICATIONS

Commissaris, "Chapter 2.6. UOP Parex Process," in Handbook of petroleum refining processes. Third Edition, Des Plaines, McGraw-Hill, pp. 2.47-2.54.
(Continued)

*Primary Examiner* — Renee Robinson
(74) *Attorney, Agent, or Firm* — Cantor Colburn LLP

(57) ABSTRACT

A process for hydrocracking a hydrocarbon feed is provided. The process comprises hydrocracking the hydrocarbon feed to produce a first hydrocracking product stream, separating the first hydrocracking product stream to form a gas stream and a liquid stream, hydrocracking the liquid stream to produce a second hydrocracking product stream, separating
(Continued)

the second hydrocracking product stream to form a first light stream and a first heavy stream comprising benzene, toluene, xylene, $C_{9+}$ hydrocarbon, or a combination comprising at least one of the foregoing, purifying the gas stream to form a purified gas stream, and separating the purified gas stream to form at least two of a hydrogen stream, $C_1$ stream, $C_2$ stream, $C_3$ stream, $C_4$ stream, $C_{5+}$ stream, or a combination comprising at least one of the foregoing.

19 Claims, 3 Drawing Sheets

(51) Int. Cl.

| | |
|---|---|
| ***C10G 67/14*** | (2006.01) |
| ***C10G 5/04*** | (2006.01) |
| ***C10G 70/04*** | (2006.01) |
| ***F25J 3/08*** | (2006.01) |

(52) U.S. Cl.
CPC ..... *C10G 70/043* (2013.01); *F25J 3/08* (2013.01); *C10G 2300/104* (2013.01); *C10G 2300/1044* (2013.01); *C10G 2300/1051* (2013.01); *C10G 2300/4006* (2013.01); *C10G 2300/4012* (2013.01); *C10G 2300/4081* (2013.01); *C10G 2400/20* (2013.01); *C10G 2400/26* (2013.01); *C10G 2400/28* (2013.01); *C10G 2400/30* (2013.01)

(56) References Cited

U.S. PATENT DOCUMENTS

| | | | |
|---|---|---|---|
| 6,931,889 | B1 | 8/2005 | Foglietta et al. |
| 8,518,351 | B2 | 8/2013 | Wieber et al. |
| 9,434,894 | B2 | 9/2016 | Mehlberg et al. |
| 2004/0171899 | A1 | 9/2004 | Pohl |

FOREIGN PATENT DOCUMENTS

| | | | | |
|---|---|---|---|---|
| WO | WO 2015/128045 | * | 9/2015 | ..... C10G 69/06 |
| WO | 2016005297 | A1 | 1/2016 | |
| WO | 2016102247 | A1 | 6/2016 | |

OTHER PUBLICATIONS

G. P. S. Association, Engineering data book 12th Edition, Tuka, 2004, Sections 2, 13, 16, 20, and 21.
Dahlberg et al., "Hydrocracking," vol. II Refining and Petrochemicals, Catalytic Conversion Processes, (2006) 26 pages.
Gas Processors Suppliers Association, "Engineering Data Book, FPS Version, vols. I & II", Section 16, Hydrocarbon Recovery, 33 pages, pp. 419-451, 27 pages.
International Search Report for International Application No. PCT/IB2018/056039; International Application Filing Date Aug. 10, 2018; dated Jan. 10, 2019; 9 pages.
Written Opinion for International Application No. PCT/IB2018/056039; International Application Filing Date Aug. 10, 2018; dated Jan. 10, 2019; 14 pages.

* cited by examiner

PROCESS AND SYSTEM FOR CRACKING A HYDROCARBON FEED

CROSS REFERENCE TO RELATED APPLICATIONS

This application is a 371 of International Application No. PCT/IB2018/056039, filed Aug. 10, 2018, which is incorporated herein by reference in its entirety, and which claims priority to and the benefit of U.S. Provisional Application No. 62/545,524, filed Aug. 15, 2017.

BACKGROUND

Hydrocracking is a catalytic process that converts hydrocarbon streams into lighter fractions in the presence of hydrogen. Conventional hydrocrackers can process heavy hydrocarbon feeds, such as vacuum gas oil, atmospheric residue, vacuum residue, or the like, to form lighter products such as methane, liquefied petroleum gas, naphtha, kerosene, and diesel. Hydrocrackers are generally operated at high pressure (e.g., pressures greater than 6 megapascals). Consequently, separation of circulating hydrogen and the various products from the hydrocracking effluent via liquid-vapor flash separation can be relatively efficient.

It would be desirable to provide processes for hydrocracking lighter hydrocarbon feeds at mild conditions, such as processes operating at lower pressures below the critical pressure of the hydrocarbon feeds (e.g., $C_5$-$C_{12}$ hydrocarbon feeds), with improved energy efficiency, reduced capital expenditure, and maximum recoveries for separating the hydrocracking effluent into hydrogen streams and the product streams.

SUMMARY

Disclosed, in various embodiments, are processes for hydrocracking a hydrocarbon feed, processes for producing a product comprising benzene, toluene, xylene, or a combination comprising at least one of the foregoing, and systems for cracking a hydrocarbon feed.

A process for hydrocracking a hydrocarbon feed includes hydrocracking the hydrocarbon feed to produce a first hydrocracking product stream, separating the first hydrocracking product stream to form a gas stream and a liquid stream, hydrocracking the liquid stream to produce a second hydrocracking product stream, separating the second hydrocracking product stream to form a first light stream and a first heavy stream, purifying the gas stream to form a purified gas stream, and separating the purified gas stream to form at least two of a hydrogen stream, $C_1$ stream, $C_2$ stream, $C_3$ stream, $C_4$ stream, $C_{5+}$ stream, or a combination comprising at least one of the foregoing. The first heavy stream can include benzene, toluene, xylene, $C_{9+}$ hydrocarbon, or a combination comprising at least one of the foregoing.

A process for producing a product comprising benzene, toluene, xylene, or a combination comprising at least one of the foregoing includes absorbing benzene, toluene, xylene, or a combination comprising at least one of the foregoing from a hydrocracking product stream into an absorbing liquid to form a first heavy stream and a first light stream, and recycling a portion of the first heavy stream to the step of absorbing, and/or separating the first light stream in a separation process comprising a cold separation process to form at least two of a hydrogen stream, $C_1$ stream, $C_2$ stream, $C_3$ stream, $C_4$ stream, a $C_{5+}$ stream, or a combination comprising at least one of the foregoing. The first light stream can include hydrogen, $C_{5-}$ hydrocarbon, or a combination comprising at least one of the foregoing from the hydrocracking product stream.

A system for cracking a hydrocarbon feed includes a first hydrocracking unit for producing a first hydrocracking product stream, a first separation unit for separating the first hydrocracking product stream to form a gas stream and a liquid stream, a second hydrocracking unit for producing a second hydrocracking product stream, a second separation unit for separating the second hydrocracking product stream, a gas purification unit to purify the gas stream to form a purified gas stream, and a cold separation unit to separate the purified gas stream.

These and other features and characteristics are more particularly described below.

BRIEF DESCRIPTION OF THE DRAWINGS

The following figures are exemplary embodiments wherein the like elements are numbered alike and which are presented for the purposes of illustrating the exemplary embodiments disclosed herein and not for the purposes of limiting the same.

Figure 1:
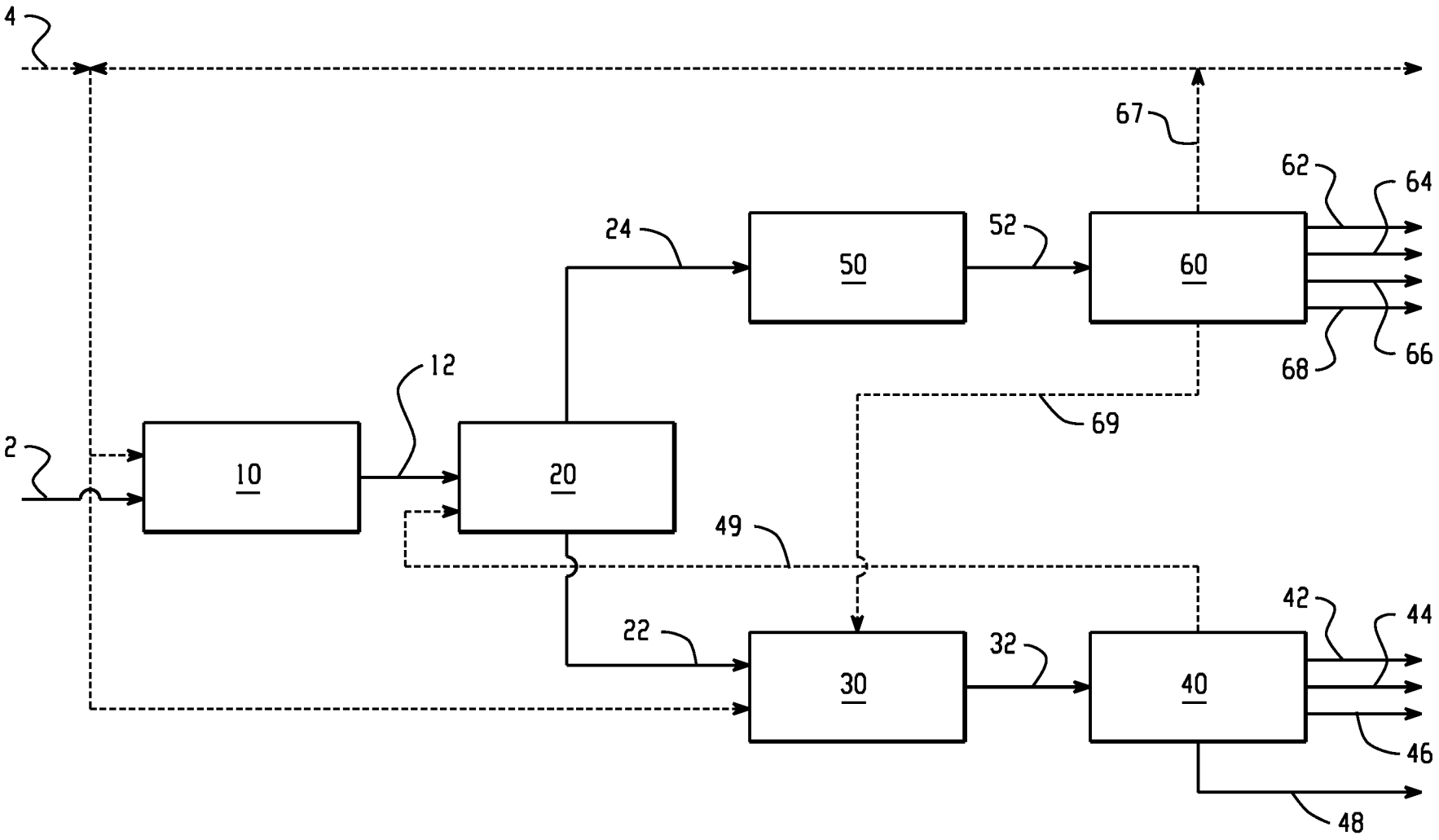
FIG. 1 is an illustration of an embodiment of a process for cracking a hydrocarbon feed.

The above described and other features are exemplified by the following detailed description, examples, and claims.

DETAILED DESCRIPTION

Described herein are processes and systems for hydrocracking hydrocarbon feeds and separating the hydrocracking product streams. The hydrocracking product streams can include benzene, toluene, xylenes, or a combination comprising at least one of the foregoing (BTX), as well as high concentrations of hydrogen and liquefied petroleum gas (LPG). Desirably, the processes and systems operate one or more hydrocracking units at moderate pressures. For example, the pressure of the one or more hydrocracking units can be 0.3 megapascals to 5.0 megapascals. Previous separation processes of effluents from hydrocracking processes and systems operating at moderate pressures suffered from difficulties in achieving the desired separation and/or were capital intensive. The present processes and systems provide high recovery of all products (i.e., at least 90% recovery) and improve the separation efficiency, while reducing energy consumption and avoiding extreme temperature profiles in distillation columns (e.g., to reduce or eliminate the risk of freezing of components such as benzene).

A process for hydrocracking a hydrocarbon feed can include hydrocracking the hydrocarbon feed to produce a first hydrocracking product stream, separating the first hydrocracking product stream to form a gas stream and a liquid stream, hydrocracking the liquid stream to produce a second hydrocracking product stream, separating the second hydrocracking product stream to form a first light stream and a first heavy stream, purifying the gas stream to form a purified gas stream, and separating the purified gas stream to form at least two of a hydrogen stream, $C_1$ stream, $C_2$ stream, $C_3$ stream, $C_4$ stream, $C_{5+}$ stream, or a combination comprising at least one of the foregoing. The first heavy stream can include benzene, toluene, xylene, $C_{9+}$ hydrocarbon, or a combination comprising at least one of the foregoing.

As used herein, "hydrocracking" refers to a catalytic cracking process in the presence of hydrogen. As used herein, "hydrocracking unit" refers to a reactor unit capable of performing a hydrocracking process. A majority of the effluent produced by hydrocracking can be LPG, which includes alkanes that can be converted to olefins. The hydrocracking can keep intact one aromatic ring of the aromatics in the hydrocarbon feed, but remove most of the side-chains from the aromatic ring. The hydrocracking can be achieved by adjusting the hydrogenation activity of the catalyst, process temperature, or space velocity of the hydrocarbon feed.

The process conditions used for hydrocracking can include a process temperature of 473.15 kelvins to 873.15 kelvins, a pressure of 0.2 megapascals to 20 megapascals, and a weight hourly space velocity of 0.1 $hours^{-1}$ to 10 $hours^{-1}$. A first hydrocracking unit can be operated at a temperature of 573.15 kelvins to 773.15 kelvins , or 673.15 kelvins to 773.15 kelvins, at a pressure of 0.5 megapascals to 3.0 megapascals, or 1.0 megapascals to 2.5 megapascals, and at a weight hourly space velocity of 0.1 $hours^{-1}$ to 10 $hours^{-1}$, or 0.2 $hours^{-1}$ to 2 $hours^{-1}$. A second hydrocracking unit can be operated at a temperature of 673.15 kelvins to 873.15 kelvins, or 723.15 kelvins to 823.15 kelvins, at a pressure of 0.5 megapascals to 3.0 megapascals, or 1.0 megapascals to 2.5 megapascals, and at a weight hourly space velocity of 0.1 $hours^{-1}$ to 10 $hours^{-1}$, or 0.2 $hours^{-1}$ to 2 $hours^{-1}$.

Many catalysts used for the hydrocracking process include various transition metals, or metal sulfides with a solid support such as alumina, silica, alumina-silica, magnesia, zeolites, or a combination comprising at least one of the foregoing. In an embodiment, the catalyst can include 0.01 weight % to 1 weight % hydrogenation metal in relation to the total catalyst weight and a zeolite having a pore size of 5 to 8 Angstroms (Å) and a silica ($SiO_2$) to alumina ($Al_2O_3$) molar ratio of 5 to 200.

Desirable hydrocarbon feeds include, but are not limited to, naphtha (such as straight run naphtha or light coker naphtha), first stage hydro-treated pyrolysis gasoline, hydrocracked gasoline, coke oven light oil, fluid catalytic cracking (FCC) gasoline, reformate, kerosene, $C_5$-$C_{12}$ hydrocarbons, or a combination comprising at least one of the foregoing. Desirably, the hydrocarbon feed can include naphtha. In an embodiment, a majority of the hydrocarbon feed comprises C6-C10 hydrocarbons.

The hydrocracking product stream can be at a temperature of 573.15 kelvins to 853.15 kelvins and a pressure of 0.3 megapascals to 5.0 megapascals.

The gas stream separated from the first hydrocracking product stream can include hydrogen and $C_1$-$C_5$ hydrocarbons. The liquid stream separated from the first hydrocracking product stream can include $C_{5+}$ hydrocarbons.

Hydrogen can be present in the first hydrocracking product stream in an amount equal to or greater than 1 weight %, or 2 weight % to 10 weight %, or 2 weight % to 8 weight %, based on the total weight of the first hydrocracking product stream. The $C_1$-$C_4$ hydrocarbons can be present in an amount equal to or greater than 30 weight %, or equal to or greater than 40 weight %, or equal to or greater 50 weight %, based on the total weight of the first hydrocracking product stream. Desirably, a boiling point of the $C_{5+}$ hydrocarbons can be 303.15 kelvins to 468.15 kelvins.

The second hydrocracking product stream formed from hydrocracking the liquid stream can include hydrogen, a $C_{5-}$ hydrocarbon, benzene, toluene, xylene, $C_{9+}$ hydrocarbon, or a combination comprising at least one of the foregoing.

Separating the second hydrocracking product stream can include absorbing benzene, toluene, xylene, $C_{9+}$ hydrocarbon, or a combination comprising at least one of the foregoing into an absorbing liquid to form the first heavy stream.

Desirably, high separation efficiency can be achieved by using absorption columns to separate the second hydrocracking product stream. Absorption columns can transfer one or more components from a gas to an absorbing liquid to separate the one or more components from the gas. To remove the absorbed components (i.e., solutes or absorbates), a stripper can be used. The absorbing liquid can then be regenerated or recovered and recycled to the absorber. Desirably, the process can include recycling a portion of the first heavy stream to the step of separating the second hydrocracking product stream to act as the absorbing liquid.

The step of separating the second hydrocracking product stream can include separating the second hydrocracking product stream to form a $C_{5-}$ stream and a $C_{6+}$ stream, separating the $C_{6+}$ stream to form a benzene stream and a $C_{7+}$ stream, separating the $C_{7+}$ stream to form a toluene stream and a $C_{8+}$ stream, and separating the $C_{8+}$ stream to form a xylene stream and a $C_{9+}$ stream. The step of separating the second hydrocracking product stream also can include recycling a portion of the $C_{6+}$ stream to the step of separating the second hydrocracking product stream.

The first light stream resulting from the separation of the second hydrocracking product stream includes $C_{5-}$ hydrocarbon. The first light stream can be fed to the step of separating the first hydrocracking product stream.

The step of purifying the gas stream formed by separating the first hydrocracking product stream can include absorption, sorption, membrane permeation, adsorption, or a combination comprising at least one of the foregoing. Purification can include sulfur removal (e.g., sweetening) by any suitable method, including but not limited to, amine absorption, caustic washing, or both and dehydration by any suitable method including, but not limited to, using molecular sieves, glycol absorption, or both. Purification can avoid the risk of freezing of water in the gas stream and corrosion in the cold separation equipment used to purify the gas stream.

The step of separating the purified gas stream can include a cold separation process.

In another aspect, a process for producing a product comprising benzene, toluene, xylene, or a combination comprising at least one of the foregoing (BTX) can include absorbing BTX from a hydrocracking product stream into an absorbing liquid to form a first heavy stream and a first light stream. The first light stream comprises hydrogen, $C_{5-}$ hydrocarbon, or a combination comprising at least one of the foregoing from the hydrocracking product stream. The hydrocracking product stream can be a second hydrocracking product stream from a process including two hydrocracking steps.

The process can include recycling a portion of the first heavy stream to the step of absorbing and/or separating the first light stream in a separation process comprising a cold separation process to form at least two of a hydrogen stream, $C_1$ stream, $C_2$ stream, $C_3$ stream, $C_5$ stream, a $C_{5+}$ stream, or a combination comprising at least one of the foregoing. The $C_{5+}$ stream can be fed to the step of hydrocracking the liquid stream to produce the second hydrocracking product stream.

The separation process can include purifying the first light stream before the cold separation process. The separation process can further include a separation of the light stream before the step of purifying.

The cold separation process can include mechanical refrigeration, self-refrigeration, a turbo expander process, or a combination comprising at least one of the foregoing. For instance, the cold separation process can include cooling the purified gas stream to form a first cooled stream, separating the first cooled stream to form a hydrogen and $C_1$ stream and a $C_{2+}$ stream, cooling the hydrogen and $C_1$ stream to form a second cooled stream, separating the second cooled stream to form a hydrogen stream and a $C_1$ stream, expanding the hydrogen stream to form a cold, low pressure hydrogen stream, feeding the cold, low pressure hydrogen stream to the step of cooling the hydrogen and $C_1$ stream, and compressing the cold, low pressure hydrogen stream. In an example, the step of compressing the cold, low pressure hydrogen stream uses work generated from expanding the hydrogen stream.

The turbo expander process can include one or more turbo expanders, for instance two turbo expanders, for expanding the hydrogen stream.

The cold separation process can be at a temperature equal to or lower than 243.15 kelvins, for example, equal to or lower than 223.15 kelvins, for example, equal to or lower than 173.15 kelvins.

A system for cracking a hydrocarbon feed can include a first hydrocracking unit for producing a first hydrocracking product stream, a first separation unit for separating the first hydrocracking product stream to form a gas stream and a liquid stream, a second hydrocracking unit for producing a second hydrocracking product stream, a second separation unit for separating the second hydrocracking product stream, a gas purification unit to purify the gas stream to form a purified gas stream (e.g., a sulfur-free and dry gas stream), and a cold separation unit to separate the purified gas stream (e.g., into streams such as a hydrogen stream, a $C_1$ stream, and a $C_2$ stream).

A more complete understanding of the components, processes, and apparatuses disclosed herein can be obtained by reference to the accompanying drawings. These figures (also referred to herein as "FIG.") are merely schematic representations based on convenience and the ease of demonstrating the present disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

In the process illustrated in FIG. 1, a hydrocarbon feed 2 can be hydrocracked over a catalyst in a first hydrocracking unit 10 to produce a first hydrocracking product stream 12. The hydrocarbon feed 2 can be naphtha, kerosene, or $C_5$-$C_{12}$ hydrocarbons. For example, the $C_5$-$C_{12}$ hydrocarbons can have a boiling point of 303.15 kelvins to 468.15 kelvins. The hydrocarbon feed 2 can include $C_6$-C10 hydrocarbons. Desirable hydrocarbon feeds 2 can include, but are not limited to first stage hydro-treated pyrolysis gasoline, straight run naphtha, hydrocracked gasoline, light coker naphtha, coke oven light oil, FCC gasoline, reformate, or a combination comprising at least one of the foregoing. In the first hydrocracking unit 10, the hydrocarbon feed 2 can be mixed with hydrogen 4 and heated.

The first hydrocracking product stream 12 can comprise hydrogen, $C_1$-$C_4$ hydrocarbons (such as liquefied petroleum gas), and $C_{5+}$ hydrocarbons (i.e., those comprising five or more carbon atoms), including aromatic hydrocarbons such as BTX. The hydrogen can be present in the first hydrocracking product stream 12 in an amount of equal to or greater than 1 weight %, or 2 to 10 weight %, or 2 to 8 weight %, based on the total weight of the first hydrocracking product stream 12. The $C_1$-$C_4$ hydrocarbons can be present in an amount of equal to or greater than 30 weight %, or greater than or equal to 40 weight %, or equal to or greater than 50 weight %, based on the total weight of the first hydrocracking product stream 12.

After partial cooling, the first hydrocracking product stream 12 enters a first separation unit 20. The first separation unit 20 separates hydrogen and $C_1$-$C_5$ hydrocarbons from $C_{5+}$ hydrocarbons to form a gas stream 24 and a liquid stream 22, respectively.

The liquid stream 22 is hydrocracked in a second hydrocracking unit 30 to convert at least a portion of the $C_{5+}$ hydrocarbons into $C_1$-$C_4$ hydrocarbons and aromatic hydrocarbons. The second hydrocracking unit 30 achieves this conversion by selectively removing of paraffinic and naphthenic co-boilers, which can affect the purity of the aromatic products. In the second hydrocracking unit 30, the liquid stream 22 and hydrogen 4 react over a catalyst to produce a second hydrocracking product stream 32.

Although the first hydrocracking unit 10 and the second hydrocracking unit 30 are each shown as one single unit, it is to be understood that in alternate embodiments the hydrocracking units comprise multiple reactors. For instance, a hydrocracking unit can comprise one, two, three, four, or more fixed-bed reactors or one, two, three, four, or more fluidized bed reactors in series, each comprising a catalyst. Intermediate coolers can be located among the reactors to remove the heat of the reaction by, for instance, producing high pressure steam.

The second separation unit 40 removes hydrogen and light hydrocarbons (e.g., $C_{5-}$ hydrocarbons) in a second hydrocracking product stream 32 from aromatic hydrocarbons. Hydrogen and light hydrocarbons in a light stream 49 are directed to the first separation unit 20, while aromatic hydrocarbons enter a distillation train where sequential separation of benzene 42, toluene 44, $C_8$ hydrocarbons 46, and $C_{9+}$ hydrocarbons 48 occurs.

Figure 2:
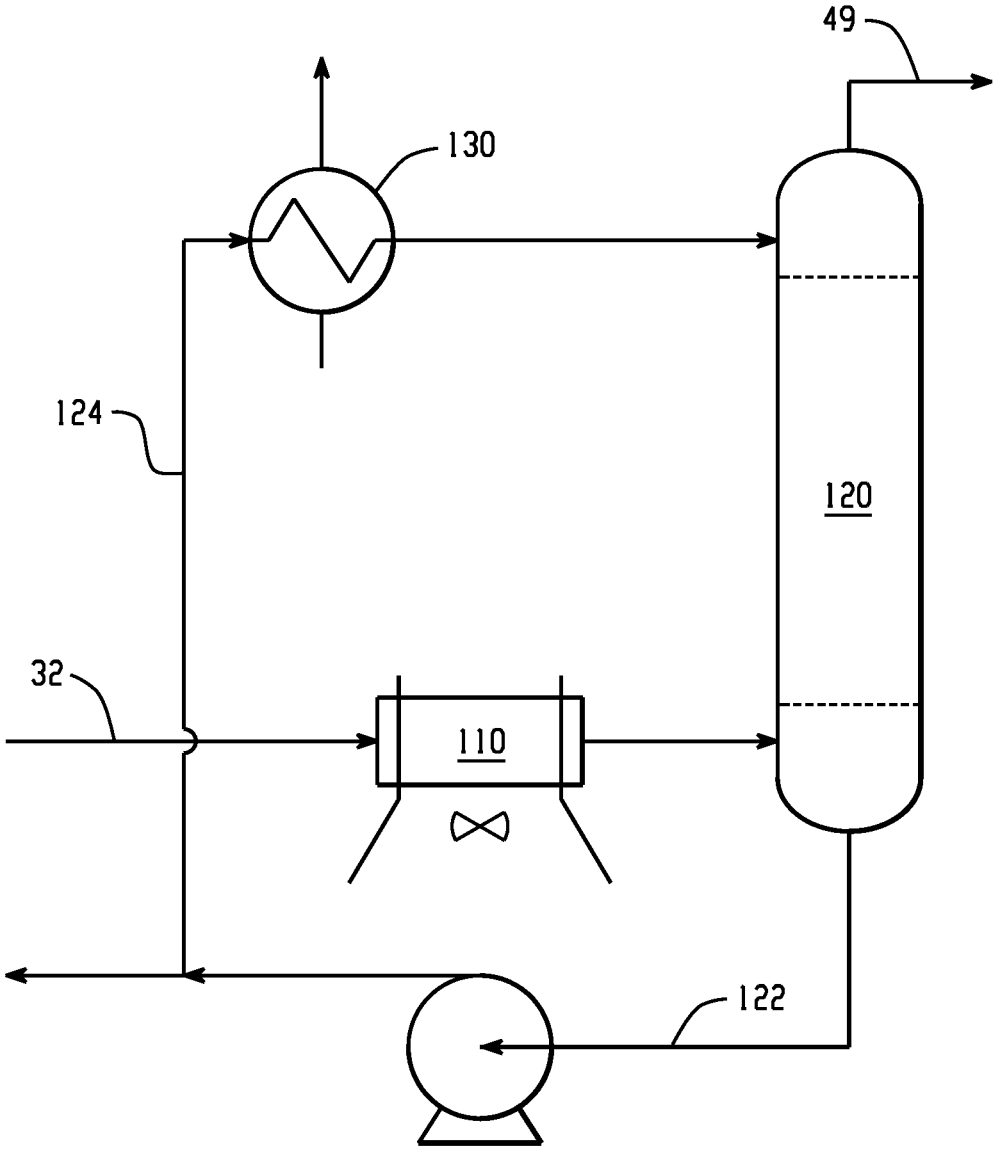
FIG. 2 is an illustration of an embodiment of a separation process for cooling and separating a second hydrocracking product stream to obtain a light stream and a heavy stream comprising benzene, toluene, and xylene.

As illustrated in further detail in FIG. 2, the second separation unit 40 comprises a cooler 110 to decrease the temperature of the second hydrocracking product stream 32 before it is fed to an absorber 120. In an alternate separation unit (not shown), the second hydrocracking product stream 32 can be fed directly to the absorber 120, without being cooled in a cooler.

The light stream 49 and the heavy stream 122 are produced by the absorber 120. The heavy stream 122 can include a high BTX concentration. For example, the high BTX concentration can be equal to or greater than 50 weight %, or for example, greater than or equal to 70 weight % BTX, based on the total weight of the heavy stream. A portion of a heavy stream 124 is cooled in a heat exchanger 130 and recycled to the absorber 120. The portion of the heavy stream 124 acts as an absorbing liquid to absorb BTX from the second hydrocarbon product stream 32. In this manner, the portion of the heavy stream 124 recycled goes through the absorber 120 without affecting the flowrates of downstream equipment (e.g., additional separation units). Stated another way, after cooling, a portion of the heavy stream 124 can be recycled to the absorber 120 and can act as an absorbing liquid to recover BTX from the second hydrocracking product stream 32.

In FIG. 1, the gas stream 24 can be purified in a gas purification unit 50. The gas purification unit 50 can remove contaminants from the gas stream 24 produced by the first separation unit 20. The gas stream 24 can be rich in hydrogen and $C_1$-$C_5$ hydrocarbons. Purification can include sulfur removal (e.g., sweetening) by amine absorption, caustic washing, dehydration using molecular sieves, glycol absorption, etc. Purification can avoid the risk of freezing of water in the purified gas stream 52 and corrosion in a cold separation unit 60.

The cold separation unit 60 can recover hydrogen and produce a hydrogen recycle stream 67. The cold separation unit 60 also can separate $C_1$-$C_4$ hydrocarbons to form $C_1$ stream 62, $C_2$ stream 64, $C_3$ stream 66, $C_4$ stream 68, and $C_{5+}$ stream 69, The $C_1$ stream 62, $C_2$ stream 64. $C_3$ stream 66, and $C_4$ stream 68 can be product streams and $C_{5+}$ stream 69 can be a recycle stream to the second hydrocracking unit 30.

Figure 3:
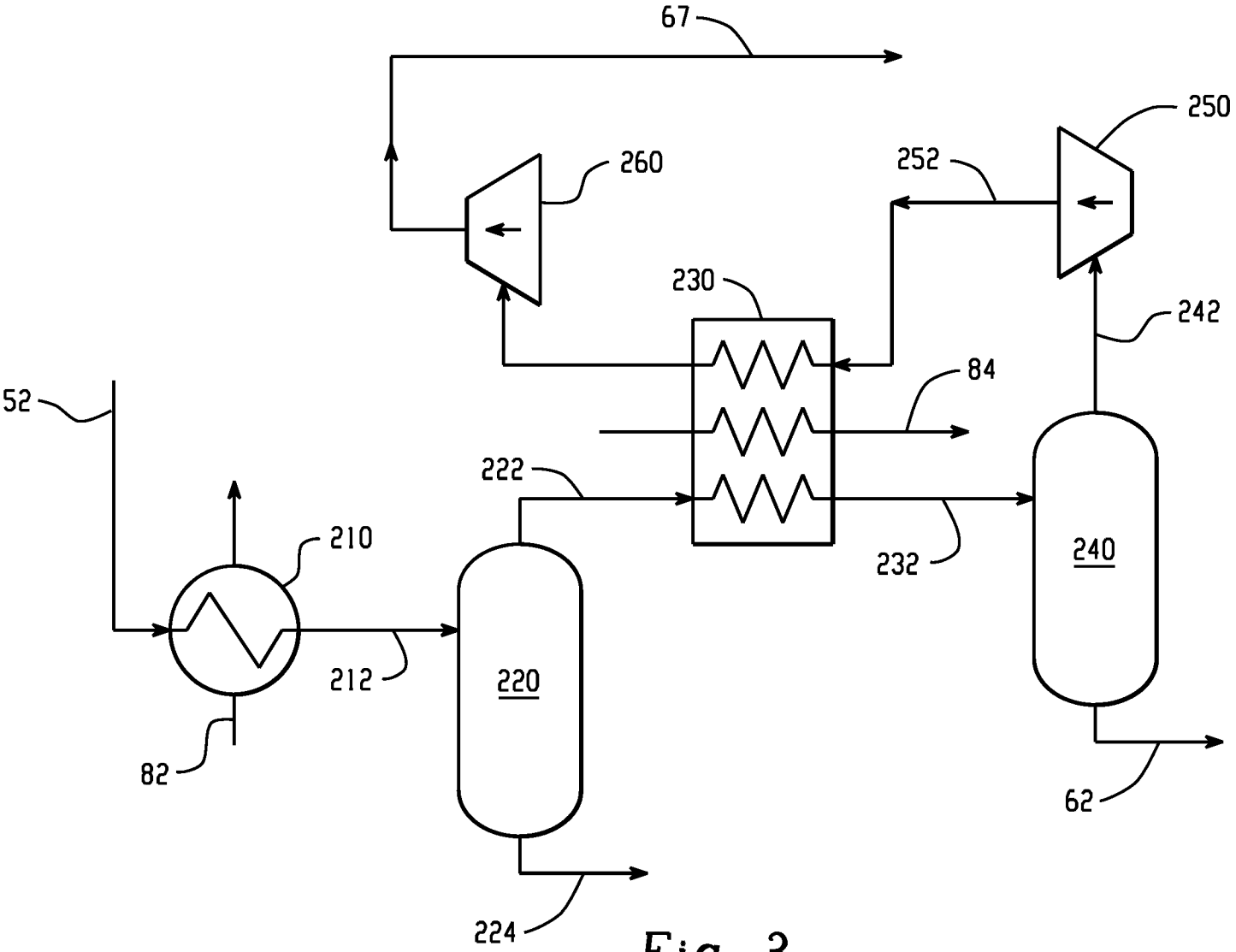
FIG. 3 is an illustration of an embodiment of a cold separation process.

As illustrated in further detail in FIG. 3, the cold separation unit 60 includes a hydrogen separation process operating at cryogenic temperatures by two means: mechanical refrigeration and self-refrigeration. First, a purified gas stream 52 can be refrigerated or cooled by mechanical refrigeration in a heat exchanger 210 using a cooling fluid 82 (e.g., ethylene, propylene or any refrigerant) to form a first cooled stream 212. As used herein, "refrigerated" or "cooled" refers to the decrease of the temperature of a stream or component.

Then, the first cooled stream 212 can be separated in a separator 220 to form a hydrogen and $C_1$ stream 222 and a $C_{3+}$ stream 224. The hydrogen and $C_1$ stream 222 can be cooled in a heat exchanger 230 to form a second cooled stream 232 using a cooling fluid 84 (e.g., ethylene, propylene or any refrigerant). The second cooled stream 232 can be separated in a separator 240 to form a hydrogen stream 242 and a $C_1$ stream 62. Hydrogen stream 242 can be expanded in a turbo expander 250 to form a cold, low pressure hydrogen stream 252, which can be fed into the heat exchanger 230 to further cool the hydrogen and $C_1$ stream 222 (e.g., self-refrigeration). Desirably, the turbo expander 250 removes energy from the hydrogen stream 242, which can cause an enhanced temperature reduction versus a simple valve for reducing the pressure of the hydrogen stream 242. The compressor 260 may utilize the energy generated from the turbo expander 250 to increase the pressure of the hydrogen recycle stream 67.

The $C_{2+}$ stream 224 can be fractionated by sequential distillation (not shown) to form a $C_2$ stream, $C_3$ stream, $C_4$ stream, $C_{5+}$ stream or a combination comprising at least one of the foregoing.

This disclosure is further illustrated by the following examples, which are non-limiting

EXAMPLES

Example 1:A computer simulation is performed for hydrocracking naphtha using the process illustrated in FIGS. 1-3. The compositions of the combined feed and effluent for each of the first hydrocracking unit and the second hydrocracking unit are summarized in Table 1. The operating parameters of the hydrocracking reactors are summarized in Table 2.

TABLE 1

| | First Hydrocracking Unit | | Second Hydrocracking Unit | |
|---|---|---|---|---|
| Component | Combined Feed (weight %) | Effluent (weight %) | Combined Feed (weight %) | Effluent (weight %) |
| Hydrogen | 5.6% | 3.9% | 6.4% | 5.2% |
| Methane | 0.0% | 2.5% | 0.0% | 4.6% |
| Ethane | 0.0% | 11.0% | 0.0% | 11.7% |
| Propane | 0.0% | 36.4% | 0.0% | 13.0% |
| Butane | 0.0% | 6.2% | 0.0% | 0.9% |
| Iso-butane | 0.0% | 7.0% | 0.0% | 1.0% |
| Cyclopentane | 0.8% | 0.0% | 0.0% | 0.0% |
| Iso-pentane | 5.6% | 9.3% | 25.9% | 0.5% |
| n-pentane | 2.6% | 0.8% | 2.2% | 0.1% |
| 3-methylpentane | 7.0% | 0.4% | 1.0% | 0.0% |
| Benzene | 0.4% | 3.0% | 8.6% | 8.6% |
| Cyclohexane | 1.0% | 0.0% | 0.0% | 0.0% |
| Methylcyclopentane | 3.9% | 0.0% | 0.0% | 0.0% |
| n-hexane | 3.5% | 0.2% | 0.5% | 0.0% |
| 1-cis,3-dimethylcyclopentane | 4.3% | 0.0% | 0.1% | 0.0% |
| 2-methylhexane | 4.8% | 0.1% | 0.2% | 0.0% |
| methylcyclohexane | 4.3% | 0.0% | 0.1% | 0.0% |
| n-heptane | 4.8% | 0.0% | 0.2% | 0.0% |
| Toluene | 1.2% | 6.6% | 18.9% | 18.9% |
| 1,1-methylethylcyclopentane | 4.7% | 0.0% | 0.0% | 0.0% |
| 1c,2dimethylcyclohexane | 4.7% | 0.0% | 0.0% | 0.0% |
| 2-methylheptane | 4.3% | 0.1% | 0.1% | 0.0% |
| Ethylbenzene | 0.6% | 0.3% | 0.8% | 0.8% |
| m-xylene | 1.9% | 7.1% | 20.3% | 20.3% |
| n-octane | 4.3% | 0.1% | 0.1% | 0.0% |
| 1,2,4-trimethylcyclohexane | 14.6% | 0.0% | 0.0% | 0.0% |
| 1,2-methylethylbenzene | 4.5% | 5.1% | 14.5% | 14.5% |
| n-nonane | 7.0% | 0.0% | 0.0% | 0.0% |
| 2,2-dimethyloctane | 3.6% | 0.0% | 0.0% | 0.0% |
| Hydrogen sulfide | 0.0% | 0.0% | 0.0% | 0.0% |
| Thiophene | 0.0% | 0.0% | 0.0% | 0.0% |

TABLE 2

| Parameter | First hydrocracking unit | Second hydrocracking unit |
|---|---|---|
| Average bed temperature | 723.15 kelvins | 773.15 kelvins |
| Inlet temperature | 703.15 kelvins | 753.15 kelvins |
| Outlet temperature | 743.15 kelvins | 793.15 kelvins |
| Inlet pressure | 13.79 barg | 13.79 barg |
| Pressure drop | 2 bar | 2 bar |
| Weight hourly space velocity (WHSV) | 1.5 $hour^{-1}$ | 1 $hour^{-1}$ |
| Hydrogen-to-hydrocarbon ratio | 3.0 mole/mole | 3.0 mole/mole |

The composition of the products recovered is shown in Table 3. Over 90% recovery of all products is achieved. Several benefits are achieved by the present processes. For example, compression of the gas stream improves the separation efficiency. Creation of a cold stream by expansion of a high pressure stream (i.e., self-refrigeration) reduces energy consumption. A lack of extreme temperature profiles in distillation columns reduces or eliminates the risk of freezing of components such as benzene. High separation efficiency is achieved by using absorption columns in the liquid separation.

TABLE 3

| COMPONENT | RECOVERY |
|---|---|
| Methane | 96.0% |
| Ethane | 99.3% |
| Propane | 97.1% |
| i-Butane | 91.5% |
| n-Butane | 98.7% |
| Benzene | 99.9% |
| Toluene | 99.8% |
| Xylenes | 97.9% |
| Ethylbenzene | 99.2% |

Examples 2 and 3: The cold separation process of FIG. 3 is compared to two alternative cold separation processes. The first alternative example does not include the turbo expander 250 and the compressor 260. The second alternative example includes the turbo expander 250, but does not include the compressor 260. The performance of these three cold separation processes are summarized in Table 4.

TABLE 4

| PARAMETERS | Example 2 | Example 3 | Example 1 |
|---|---|---|---|
| Description | Mechanical refrigeration | Mechanical refrigeration and gas expansion | Mechanical refrigeration, gas expansion and compression |
| $H_2$ recycle temperature after expansion | — | 139.85 kelvins | 119.65 kelvins |
| $H_2$ recycle pressure after expansion | — | 15.5 barg | 8.8 barg |
| Temperature in separator 240 | 176.65 kelvin | 163.35 kelvins | 155.85 kelvins |
| $H_2$ recycle purity | 28.6 weight % (77.1 mole %) | 34.4 weight % (81.1 mole %) | 38.8 weight % (83.7 mole %) |
| Reduction in $H_2$ recycle mass flowrate | 0% | 16% | 25% |
| $H_2$ feed to reactors purity (recycle and makeup) | 37.8 weight % (83.6 mole %) | 44.2 weight % (86.6 mole %) | 48.8 weight % (88.6 mole %) |

Increased hydrogen purity and reduction in recycle flowrate is seen by using the configurations including a gas expansion (i.e., turbo expander process).

The processes and systems disclosed herein include(s) at least the following aspects:

Aspect 1: A process for hydrocracking a hydrocarbon feed, comprising hydrocracking the hydrocarbon feed to produce a first hydrocracking product stream; separating the first hydrocracking product stream to form a gas stream and a liquid stream; hydrocracking the liquid stream to produce a second hydrocracking product stream; separating the second hydrocracking product stream to form a first light stream and a first heavy stream comprising benzene, toluene, xylene, $C_{9+}$ hydrocarbon, or a combination comprising at least one of the foregoing; purifying the gas stream to form a purified gas stream; and separating the purified gas stream to form at least two of a hydrogen stream, $C_1$ stream, $C_2$ stream, $C_3$ stream, $C_4$ stream, $C_{5+}$ stream, or a combination comprising at least one of the foregoing.

Aspect 2: The process of Aspect 1, wherein the gas stream comprises hydrogen and $C_1$-C5 hydrocarbons and the liquid stream comprises $C_{5+}$ hydrocarbons.

Aspect 3: The process of any one or more of the preceding aspects, wherein the second hydrocracking product stream comprises a $C_{5-}$ hydrocarbon, benzene, toluene, xylene, $C_{9+}$ hydrocarbon, or a combination comprising at least one of the foregoing.

Aspect 4: The process of any one or more of the preceding aspects, wherein the separating the second hydrocracking product stream comprises absorbing benzene, toluene, xylene, $C_{9+}$ hydrocarbon, or a combination comprising at least one of the foregoing into an absorbing liquid to form the first heavy stream.

Aspect 5: The process of any one or more of the preceding aspects, further comprising recycling a portion of the first heavy stream to the step of separating the second hydrocracking product stream to act as the absorbing liquid.

Aspect 6: The process of any one or more of the preceding aspects, wherein separating the second hydrocracking product stream comprises the following steps: separating the second hydrocracking product stream to form a $C_{5-}$ stream and a $C_{6+}$ stream; separating the $C_{6+}$ stream to form a benzene stream and a $C_{7+}$ stream; separating the $C_{7+}$ stream to form a toluene stream and a $C_{8+}$ stream; and separating the $C_8$ stream to form a xylene stream and a $C_{9+}$ stream.

Aspect 7: The process of Aspect 6, further comprising: recycling a portion of the $C_{6+}$ stream to the step of separating the second hydrocracking product stream;

Aspect 8: The process of any one or more of the preceding aspects, wherein the step of separating the purified gas stream comprises a cold separation process.

Aspect 9: The process of any one or more of the preceding aspects, wherein the first light stream comprises $C_{5-}$ hydrocarbon, and wherein the first light stream is fed to the step of separating the first hydrocracking product stream.

Aspect 10: The process of any one or more of the preceding aspects, wherein the $C_{5+}$ stream is fed to the step of hydrocracking the liquid stream.

Aspect 11: A process for producing a product comprising benzene, toluene, xylene, or a combination comprising at least one of the foregoing, comprising: absorbing benzene, toluene, xylene, or a combination comprising at least one of the foregoing from a hydrocracking product stream into an absorbing liquid to form a first heavy stream and a first light stream, wherein the first light stream comprises hydrogen, $C_{5-}$ hydrocarbon, or a combination comprising at least one of the foregoing from the hydrocracking product stream; and recycling a portion of the first heavy stream to the step of absorbing; and/or separating the first light stream in a separation process comprising a cold separation process to form at least two of a hydrogen stream, $C_1$ stream, $C_2$ stream, $C_3$ stream, $C_4$ stream, a $C_{5+}$ stream, or a combination comprising at least one of the foregoing.

Aspect 12: The process of Aspect 11, wherein the separation process comprises purifying the first light stream before the cold separation process.

Aspect 13: The process of Aspect 12, wherein the separation process further comprises a separation of the light stream before the step of purifying.

Aspect 14: The process of any one or more of Aspects 8-13, wherein the cold separation process comprises mechanical refrigeration, self-refrigeration, a turbo expander process, or a combination comprising at least one of the foregoing.

Aspect 15: The process of any one or more of Aspects 8-14, wherein the cold separation process comprises, cooling the purified gas stream to form a first cooled stream; separating the cooled stream to form a hydrogen and $C_1$ stream and a $C_{2+}$ stream; cooling the hydrogen and $C_1$ stream to form a second cooled stream; separating the second cooled stream to form a hydrogen stream and a $C_1$ stream; expanding the hydrogen stream to form a cold, low pressure hydrogen stream; feeding the cold, low pressure hydrogen stream to the step of cooling the hydrogen and $C_1$ stream; and compressing the cold, low pressure hydrogen stream.

Aspect 16: The process of Aspect 15, wherein the step of compressing the cold, low pressure hydrogen stream uses work generated from expanding the hydrogen stream.

Aspect 17: The process of any one or more of Aspects 8-16, wherein the cold separation process is at a temperature equal to or less than 243.15 kelvins, preferably equal to or lower than 223.15 kelvins, more preferably equal to or lower than 173.15 kelvins.

Aspect 18: The process of any one or more of the preceding aspects, wherein purifying comprises absorption, sorption, membrane permeation, adsorption, or a combination comprising at least one of the foregoing.

Aspect 19: The process of any one or more of the preceding aspects, wherein the hydrocracking product stream is at a temperature of 573.15 kelvins to 853.15 kelvins and a pressure of 0.3 megapascals to 5.0 megapascals.

Aspect 20: A system for cracking a hydrocarbon feed, comprising a first hydrocracking unit for producing a first hydrocracking product stream, a first separation unit for separating the first hydrocracking product stream to form a gas stream and a liquid stream, a second hydrocracking unit for producing a second hydrocracking product stream, a second separation unit for separating the second hydrocracking product stream, a gas purification unit to purify the gas stream to form a purified gas stream, and a cold separation unit to separate the purified gas stream.

In general, the invention may alternately comprise, consist of, or consist essentially of, any appropriate components herein disclosed. The invention may additionally, or alternatively, be formulated so as to be devoid, or substantially free, of any components, materials, ingredients, adjuvants or species used in the prior art compositions or that are otherwise not necessary to the achievement of the function and/or objectives of the present invention. The endpoints of all ranges directed to the same component or property are inclusive and independently combinable (e.g., ranges of "less than or equal to 25 wt %, or 5 wt % to 20 wt %," is inclusive of the endpoints and all intermediate values of the ranges of "5 wt % to 25 wt %," etc.). Disclosure of a narrower range or more specific group in addition to a broader range is not a disclaimer of the broader range or larger group. "Combination" is inclusive of blends, mixtures, alloys, reaction products, and the like. Furthermore, the terms "first," "second," and the like, herein do not denote any order, quantity, or importance, but rather are used to denote one element from another. The terms "a" and "an" and "the" herein do not denote a limitation of quantity, and are to be construed to cover both the singular and the plural, unless otherwise indicated herein or clearly contradicted by context. "Or" means "and/or." The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

The modifier "about" used in connection with a quantity is inclusive of the stated value and has the meaning dictated by the context (e.g., includes the degree of error associated with measurement of the particular quantity). The notation "±10%" means that the indicated measurement can be from an amount that is minus 10% to an amount that is plus 10% of the stated value. The terms "front", "back", "bottom", and/or "top" are used herein, unless otherwise noted, merely for convenience of description, and are not limited to any one position or spatial orientation. "Optional" or "optionally" means that the subsequently described event or circumstance can or cannot occur, and that the description includes instances where the event occurs and instances where it does not. Unless defined otherwise, technical and scientific terms used herein have the same meaning as is commonly understood by one of skill in the art to which this invention belongs. A "combination" is inclusive of blends, mixtures, alloys, reaction products, and the like.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A process for hydrocracking a hydrocarbon feed, comprising:

hydrocracking the hydrocarbon feed to produce a first hydrocracking product stream;

separating the first hydrocracking product stream to form a gas stream and a liquid stream;

hydrocracking the liquid stream to produce a second hydrocracking product stream;

separating the second hydrocracking product stream to form a first light stream and a first heavy stream comprising benzene, toluene, xylene, $C9_+$ hydrocarbon, or a combination comprising at least one of the foregoing;

purifying the gas stream to form a purified gas stream; and separating the purified gas stream to form a hydrogen stream, $C_1$ stream, $C_2$ stream, $C_3$ stream, $C_4$ stream, $C_{5+}$ stream, or a combination comprising at least one of the foregoing, wherein the separating the second hydrocracking product stream comprises absorbing benzene, toluene, xylene, $C_{9+}$ hydrocarbon, or a combination comprising at least one of the foregoing into an absorbing liquid to form the first heavy stream; or the step of separating the purified gas stream comprises a cold separation process, and the cold separation process comprises, cooling the purified gas stream to form a first cooled stream;

separating the cooled stream to form a hydrogen and $C_1$ stream and a $C_{2+}$ stream;

cooling the hydrogen and $C_1$ stream to form a second cooled stream;

separating the second cooled stream to form a hydrogen stream and a $C_1$ stream;

expanding the hydrogen stream to form a cold, low pressure hydrogen stream;

feeding the cold, low pressure hydrogen stream to the step of cooling the hydrogen and $C_1$ stream; and compressing the cold, low pressure hydrogen stream.

2. The process of claim 1, wherein the gas stream comprises hydrogen and $C_1$-$C_5$ hydrocarbons and the liquid stream comprises $C_{5+}$ hydrocarbons.

3. The process of claim 1, wherein the second hydrocracking product stream comprises a $C_{5-}$ hydrocarbon, benzene, toluene, xylene, $C_{9+}$ hydrocarbon, or a combination comprising at least one of the foregoing.

4. The process of claim 1, wherein the separating the second hydrocracking product stream comprises absorbing benzene, toluene, xylene, $C_{9+}$ hydrocarbon, or a combination comprising at least one of the foregoing into an absorbing liquid to form the first heavy stream.

5. The process of claim 1, further comprising recycling a portion of the first heavy stream to the step of separating the second hydrocracking product stream to act as the absorbing liquid.

6. The process of claim 1, wherein separating the second hydrocracking product stream comprises the following steps:

separating the second hydrocracking product stream to form a $C_{5-}$ stream and a $C_{6+}$ stream;

separating the $C_{6+}$ stream to form a benzene stream and a $C_{7+}$ stream;

separating the $C_{7+}$ stream to form a toluene stream and a $C_{8+}$ stream; and separating the $C_{8+}$ stream to form a xylene stream and a $C_{9+}$ stream.

7. The process of claim 6, further comprising:

recycling a portion of the $C_{6+}$ stream to the step of separating the second hydrocracking product stream to form the $C_{5-}$ stream and the $C_{6+}$ stream.

8. The process of claim 1, wherein the step of separating the purified gas stream comprises a cold separation process, and the cold separation process comprises a turbo expander process.

9. The process of claim 8, wherein the cold separation process comprises, cooling the purified gas stream to form a first cooled stream;

separating the cooled stream to form a hydrogen and $C_1$ stream and a $C_{2+}$ stream;

cooling the hydrogen and $C_1$ stream to form a second cooled stream;

separating the second cooled stream to form a hydrogen stream and a $C_1$ stream;

expanding the hydrogen stream to form a cold, low pressure hydrogen stream;

feeding the cold, low pressure hydrogen stream to the step of cooling the hydrogen and $C_1$ stream; and compressing the cold, low pressure hydrogen stream.

10. The process of claim 9, wherein the step of compressing the cold, low pressure hydrogen stream uses work generated from expanding the hydrogen stream.

11. The process of claim 8, wherein the cold separation process is at a temperature equal to or less than 223.15 kelvins.

12. The process of claim 8, wherein the purifying comprises sulfur removal.

13. The process of claim 1, wherein the first light stream comprises $C_{5-}$ hydrocarbon, and wherein the first light stream is fed to the step of separating the first hydrocracking product stream.

14. The process of claim 1, wherein the $C_{5+}$ stream is fed to the step of hydrocracking the liquid stream.

15. The process of claim 1, wherein purifying comprises absorption, sorption, membrane permeation, adsorption, or a combination comprising at least one of the foregoing.

16. The process of claim 1, wherein the hydrocracking product stream is at a temperature of 573.15 kelvins to 853.15 kelvins and a pressure of 0.3 megapascals to 5.0 megapascals.

17. A process for producing a product comprising benzene, toluene, xylene, or a combination comprising at least one of the foregoing, comprising:

absorbing benzene, toluene, xylene, or a combination comprising at least one of the foregoing from a hydrocracking product stream into an absorbing liquid to form a first heavy stream and a first light stream, wherein the first light stream comprises hydrogen, $C_{5-}$ hydrocarbon, or a combination comprising at least one of the foregoing from the hydrocracking product stream; and recycling a portion of the first heavy stream to the step of absorbing; and/or separating the first light stream in a separation process comprising a cold separation process to form a hydrogen stream, $C_1$ stream, $C_2$ stream, $C_3$ stream, $C_4$ stream, a $C_{5+}$ stream, or a combination comprising at least one of the foregoing.

18. The process of claim 17, wherein the separation process comprises purifying the first light stream before the cold separation process.

19. The process of claim 18, wherein the separation process further comprises a separation of the light stream before the step of purifying.

* * * * *